US009303359B2

(12) United States Patent
Hund et al.

(10) Patent No.: US 9,303,359 B2
(45) Date of Patent: Apr. 5, 2016

(54) METHOD FOR MANUFACTURING PAPER USING A CATIONIC POLYMER OBTAINED BY HOFMANN DEGRADATION

(71) Applicant: S.P.C.M. SA, Andrezieux Boutheon (FR)

(72) Inventors: René Hund, Villars (FR); Christophe Auriant, Saint Etienne (FR)

(73) Assignee: S.P.C.M SA, Andrezieux Boutheon (FR)

( * ) Notice: Subject to any disclaimer, the term of this patent is extended or adjusted under 35 U.S.C. 154(b) by 0 days.

(21) Appl. No.: 14/408,889

(22) PCT Filed: Jun. 17, 2013

(86) PCT No.: PCT/FR2013/051406

§ 371 (c)(1),
(2) Date: Dec. 17, 2014

(87) PCT Pub. No.: WO2014/009621

PCT Pub. Date: Jan. 16, 2014

(65) Prior Publication Data

US 2015/0176208 A1 Jun. 25, 2015

(30) Foreign Application Priority Data

Jul. 9, 2012 (FR) ..... 12 56575

(51) Int. Cl.

| | |
|---|---|
| ***D21H 17/00*** | (2006.01) |
| ***D21H 17/45*** | (2006.01) |
| ***D21H 21/10*** | (2006.01) |
| ***D21F 1/82*** | (2006.01) |
| ***D21H 17/67*** | (2006.01) |
| *D21H 17/55* | (2006.01) |

(52) U.S. Cl.

CPC ..... *D21H 17/74* (2013.01); *D21F 1/82* (2013.01); *D21H 17/45* (2013.01); *D21H 17/67* (2013.01); *D21H 21/10* (2013.01); *D21H 17/55* (2013.01)

(58) Field of Classification Search

USPC ..... 162/164.2
IPC ..... D21H 17/74,17/67
See application file for complete search history.

(56) References Cited

U.S. PATENT DOCUMENTS

| | | | |
|---|---|---|---|
| 5,126,014 | A | 6/1992 | Chung |
| 2006/0024262 | A1 | 2/2006 | Hahnle et al. |
| 2009/0272506 | A1 | 11/2009 | Esser et al. |
| 2011/0263796 | A1 | 10/2011 | Hund et al. |
| 2012/0073774 | A1 | 3/2012 | Jehn-Rendu et al. |
| 2012/0132382 | A1 | 5/2012 | Hund et al. |
| 2013/0139986 | A1 | 6/2013 | Faucher et al. |

FOREIGN PATENT DOCUMENTS

| | | | |
|---|---|---|---|
| EP | 0187956 | * | 7/1986 |
| JP | 5777398 | A | 5/1982 |
| WO | 2009/036271 | A1 | 3/2009 |
| WO | 2010/061082 | A1 | 6/2010 |
| WO | 2011/015783 | A1 | 2/2011 |
| WO | 2012/017172 | A1 | 2/2012 |

OTHER PUBLICATIONS

International Search Report for PCT/FR2013/051406 dated Aug. 21, 2013.

* cited by examiner

*Primary Examiner* — Mark Halpern
(74) *Attorney, Agent, or Firm* — Heslin Rothenberg Farley & Mesiti P.C.

(57) ABSTRACT

Process for manufacturing a sheet of paper and/or board, according to which, in a plant comprising a fan pump and a head box:

a cellulose fiber suspension is prepared;
the white waters are introduced into the thick stock;
the mixture is homogenized in the fan pump;
the thin stock is transferred to the head box;
the sheet is formed and then dried, characterized in that, before homogenization of the mixture in the fan pump, a cationic copolymer obtained by Hofmann degradation reaction is introduced into the white waters and/or the thick stock and/or the mixture formed by the white waters and the thick stock.

20 Claims, No Drawings

METHOD FOR MANUFACTURING PAPER USING A CATIONIC POLYMER OBTAINED BY HOFMANN DEGRADATION

CROSS REFERENCE TO RELATED APPLICATIONS

This application is a national stage filing under section 371 of International Application No. PCT/FR2013/051406, filed on Jun. 17, 2013, and published on Jan. 16, 2014 as WO 2014/009621, which claims priority to French Application No. 1256575, filed on Jul. 9, 2012. The entire contents of each of said applications are hereby incorporated herein by reference.

The invention relates to an improved process for manufacturing paper, board or the like using at least one cationic polymer obtained by Hofmann degradation and that makes it possible to increase the content of fillers in said papers or boards, while retaining advantageous physical strength properties. Another subject of the invention is the papers or boards obtained by this process.

The polymers obtained by Hofmann degradation are chemical compounds commonly used in the paper manufacturing industry. For example, document WO 2011/015783 describes in particular cationic (co)polymers derived from acrylamide obtained by a Hofmann degradation. These compounds are added as drainage aids to thin stocks, or for improving the dry strength performances, also to thin stocks.

The composition of most of the fibre suspensions used in the manufacture of paper contain, following a direct addition or indirect addition (by use of recycled papers), inorganic fillers such as clays, kaolins, calcium carbonate or else titanium dioxide. Industrially, the most commonly used fillers are calcium carbonates, whether they are in ground form (referred to as GCC for ground calcium carbonate), or else in precipitated form (referred to as PCC for precipitated calcium carbonate). Currently, regarding the significant increase in the price of paper fibres, there is a growing interest in substituting, in the sheet, a portion of the fibre with less expensive mineral fillers.

Conventionally, retention aids are used in order to increase the overall retention in the sheet (FPR: first pass retention) and in particular the retention of fillers (FPAR: first pass ash retention). Chemically, these retention aids are, generally, polymers of high molecular weight (i.e. greater than 1 million g/mol), such as acrylamide copolymers. These polymers may be combined with microparticulate inorganic compounds (bentonite, colloidal silica).

However, the increase in the content of fillers, to the detriment of the fibres, with this very widespread technology has a tendency to deteriorate the physical properties of the paper. The amount of fillers incorporated into the sheet is therefore limited due to strength constraints.

The retention aids conventionally used are added to the thin stock, i.e. a fibre suspension containing from 0.1 to 1.5% solids. They make it possible to improve filler retention, i.e. to optimize the amount of filler used. Their role consists in particular in retaining the fillers in the paper and thus in reducing the amount of fillers discharged into the white waters resulting from the drainage of the sheet during the formation thereof on the wire.

Document WO 2009/036271 describes a process that makes it possible to increase the filler content in the paper by pre-flocculation of the filler slurry in the presence of two flocculants injected successively, and combined with an overall (first-pass) retention aid added in the vicinity of the head box. However, this technique remains difficult to implement due to the multitude of compounds added according to a well-defined sequence.

Documents US 2006/0024262 and US 2009/0272506 describe a treatment using an amphoteric polyvinylamine (PVA) resulting from the hydrolysis of an N-vinylformamide (NVF) base copolymer.

Document US 2012/073774 A1 describes a process involving the addition of a cationic polymer and of an aqueous suspension of sizing agent. The cationic polymer is preferably a polyvinylamine that can be obtained in particular by hydrolysis or by the Hofmann degradation reaction. These two compounds are typically incorporated into the thin stock. They make it possible to reduce the adhesion of the sheet of paper to the wire, during drying.

Although these processes make it possible to introduce an advantageous filler content into the sheet while maintaining acceptable physical properties, they nevertheless have limits. There is therefore a need to further increase the amount of fillers without however deteriorating the physical properties of the paper.

The problem that the invention proposes to solve relates in particular to the optimal increase in the amount of fillers, or filler content, in the sheets of paper or the boards, while retaining satisfactory physical properties.

The present invention proposes an improved process for manufacturing paper, board and the like, comprising the addition, to a fibre suspension, of at least one polymer obtained by Hofmann degradation, characterized in that the polymer obtained by Hofmann degradation is cationic, and added before the fan pump of the thick stock with the white waters.

More specifically, the present invention relates to a process for manufacturing a sheet of paper and/or board and the like, according to which, in a plant comprising a fan pump and a head box:

- a cellulose fibre suspension, referred to as thick stock, is prepared, into which fillers are advantageously introduced;
- the white waters resulting from the drainage of the sheet are introduced into the thick stock;
- the mixture thus obtained is homogenized in the fan pump;
- the thin stock resulting from the homogenization is transferred to the head box;
- the sheet is formed;
- the sheet is dried.

This process is characterized in that, before homogenization of the mixture in the fan pump, that is to say before the fan pump, a cationic copolymer obtained by Hofmann degradation reaction is introduced into the white waters and/or the thick stock and/or the mixture formed by the white waters and the thick stock.

With regard to the prior art, it is quite surprising to observe that a cationic version of the polymer obtained by Hofmann degradation, when it is introduced into the process as mentioned above, can lead to better performances than the amphoteric versions in terms of filler retention while retaining very good physical strength properties.

Another subject of the present invention is the papers or boards obtained capable of being obtained according to this process.

Without being tied to any one theory, the Applicant considers that the cationic polymer obtained by Hofmann degradation may act as an activator of affinities between the fillers and the fibres, which enables the fillers to be retained quantitatively in the paper sheet from the moment of the formation of the paper network. Furthermore, this very good affinity appears to strengthen the cohesion of the structure of the paper sheet, thus giving it unequalled physical strength relative to the percentage of filler present in the sheet.

As mentioned above, in a process for manufacturing paper, board or the like, the white waters are added to the thick stock before the fan pump. Once mixed, the stock forms a thin stock which, at the outlet of the fan pump, goes to the head box where the wet sheet is formed before being dried. Generally, a shearing step is provided between the fan pump and the head box: this is the pressure screen. The fillers are added generally in slurry form to the thick stock. However, these fillers may originate from a raw material that contains fillers, for example deinked stocks, broke stocks/sized stocks, etc.

The thick stock, or thick fibre suspension generally contains between 2% and 5% solids.

As already indicated, the cationic polymer obtained by Hofmann degradation may be introduced into the process in the thick stock and/or in the white waters and/or in the mixture of the two before the fan pump.

Conventionally, the fillers are added, especially in slurry form, before the fan pump. They are added to the thick stock and/or the white waters and/or the mixture of the two, in one or more additions. The fillers are nevertheless usually advantageously added to the thick stock.

In a first embodiment, the polymer is added in the immediate vicinity of the filler introduction point or points.

In a second embodiment, the cationic polymer is introduced at the same time as the fillers. Advantageously, it is introduced in this case into the filler slurry or during the preparation thereof.

When the polymer is introduced into the white waters, it is advantageously introduced just before the mixing thereof with the thick stock.

A filler "slurry" denotes an aqueous dispersion containing fillers. Generally a slurry contains more than 10% fillers by weight.

The improved process according to the invention may also comprise the addition, to the papermaking sequence, of any other mineral compound or natural or synthetic polymer well known to a person skilled in the art. Mention will be made, non-limitingly, of the addition of at least one additive selected from the group comprising coagulants (PAC (polyaluminium chloride), polyDADMAC, polyamine), retention aids (anionic, cationic or amphoteric polymers, bentonites, siliceous materials), dry strength agents (DSRs—dry strength resins) (native starch, cationic starch, polyvinylamine) or else drainage aids (polyethyleneimine).

In one particular embodiment, the process according to the invention comprises the addition of at least one cationic polymer obtained by Hofmann degradation before the fan pump, and of at least one acrylamide-based cationic polymer to the thin stock, that is to say after the fan pump. Preferably, this acrylamide-based cationic polymer has a molecular weight of greater than 1 million g/mol.

The amount of cationic polymer obtained by Hofmann degradation introduced according to the process of the invention is between 50 and 4000 g of active polymer per tonne of dry stock (g/t). Preferably, the amount introduced is between 100 g/t and 1000 g/t.

The Hofmann degradation is a reaction discovered by Hofmann at the end of the nineteenth century, which makes it possible to convert an amide into a primary amine by eliminating carbon dioxide. The reaction mechanism is given in detail below.

In the presence of a base (sodium hydroxide) a proton is removed from the amide.

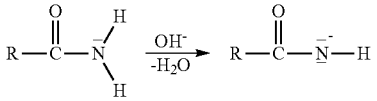

The amidate ion formed then reacts with the active chlorine ($Cl_2$) of the hypochlorite (e.g.: NaClO, which is in equilibrium: 2 $NaOH+Cl_2 \Leftrightarrow NaClO+NaCl+H_2O$) to give an N-chloramide. The base (NaOH) removes a proton from the chloramide to form an anion. The anion loses a chloride ion to form a nitrene, which undergoes a rearrangement to an isocyanate.

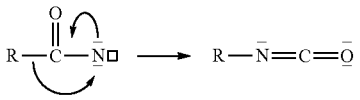

Via reaction between the hydroxide ion and the isocyanate, a carbamate is formed.

$$R—\bar{N}=C=\bar{O}+OH^- \rightarrow R—NH—CO_2^-$$

After decarboxylation (elimination of $CO_2$) starting from the carbamate, a primary amine is obtained.

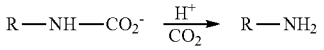

For the conversion of all or some of the amide functions of an acrylamide (co)polymer to amine functions, 2 main factors are involved (expressed as molar ratios). These are: —Alpha= (alkali and/or alkaline-earth metal hypohalide/acrylamide) and —Beta=(alkali and/or alkaline-earth metal hydroxide/alkali and/or alkaline-earth metal hypohalide). The cationic polymers obtained by Hofmann degradation used in the process according to the invention are advantageously selected from the polymers described in document WO 2011/015783.

They are obtained by Hofmann degradation on a precursor based on acrylamide or derivatives, otherwise referred to as base (co)polymer, previously modified with at least one polyfunctional compound containing at least 3 identical or different heteroatoms that each have at least one mobile hydrogen.

The heteroatoms may be: N, S, O and P.

The polyfunctional compounds may especially be oligomers, polymers or carbon-based chains comprising at least three carbon atoms.

In one advantageous embodiment, the polyfunctional compound may be selected from the group comprising polyethyleneimines (PEIs), polyamines (primary or secondary), polyallylamines, polyamine amides (PAAs), polythiols, polyalcohols, polyamide-epichlorohydrin (PAE) resins, and mixtures thereof.

In one preferred embodiment, the polyfunctional compound incorporated may be polyethyleneimine (PEI) or a polyamine amide (PAA).

In practice, the polymer obtained at the end of the Hofmann reaction could be branched, owing to branching of the base polymer. In other words, it is the branched nature of the base copolymer which will impart its branched state to the final polymer.

In one preferred embodiment, the polymer is obtained by Hofmann degradation reaction in the presence, as hypohalide, of an alkali metal hypochlorite, advantageously sodium hypochlorite.

According to another feature, the hypohalide/nonionic monomer Alpha coefficient (expressed as molar ratio) used for the preparation of the polymers of the invention is greater than 0.3, or even greater than 0.5, advantageously between 0.8 and 1 inclusive.

According to another feature, the Hofmann degradation product is produced at a concentration of greater than 4% by weight, preferably greater than 5%, advantageously greater than 7%.

In addition, the copolymer of the invention may have a cationic charge density preferably greater than 2 meq/g and advantageously greater than 5 meq/g.

The polymer used in the process according to the invention is advantageously obtained by Hofmann degradation reaction on a base copolymer comprising:

- at least 5 mol % of a non-ionic monomer selected from the group comprising acrylamide (and/or methacrylamide), N,N-dimethylacrylamide and/or acrylonitrile, preferably acrylamide,
- at least 0.001 mol % of at least one additional polyfunctional compound selected from the group comprising polyethyleneimine, polyamine (primary or secondary), polyallylamine, polythiols, advantageously polyethyleneimine,
- optionally at least:
  - one unsaturated cationic ethylenic monomer, preferably selected from the group comprising monomers of dialkylaminoalkyl(meth)acrylamide, diallylamine and methyldiallylamine type and the quaternary ammonium or acid salts thereof. Mention will be made, in particular, of dimethyldiallylammonium chloride (DADMAC), acrylamidopropyltrimethylammonium chloride (APTAC) and/or methacrylamidopropyltrimethylammonium chloride (MAPTAC),
  - and/or one nonionic monomer preferably selected from the group comprising N-vinyl acetamide, N-vinyl formamide, N-vinylpyrrolidone and/or vinyl acetate.

Advantageously, the base polymer is branched and preferably consists of the following three types of compounds:

- acrylamide,
- polyethyleneimine, and
- at least one unsaturated cationic ethylenic comonomer, selected from the group comprising monomers of dialkylaminoalkyl(meth)acrylamide, diallylamine and methyldiallylamine type and the quaternary ammonium or acid salts thereof, preferably dimethyldiallylammonium chloride.

It is important to note that, in combination with these monomers, it is also possible to use water-insoluble monomers such as acrylic, allyl or vinyl monomers comprising a hydrophobic group. During their use, these monomers will be employed in amounts generally of less than 20 mol %, preferably less than 10 mol %. They may be selected preferably from the group comprising acrylamide derivatives, such as N-alkylacrylamides, for example N-tert-butylacrylamide, octylacrylamide and also N,N-dialkylacrylamides such as N,N-dihexylacrylamide, etc.

In one preferred embodiment, the precursor based on acrylamide or derivatives (otherwise referred to as base polymer on which the Hofmann degradation is carried out) incorporates, at its very heart, at least polyethyleneimine (PEI);

- the hypohalide/nonionic monomer Alpha coefficient used for the preparation of the polymers of the invention is between 0.8 and 1 inclusive;
- the base copolymer is branched.

The branching may be carried out preferably during (or optionally after) the polymerization of the "base" copolymer, in the presence of a polyfunctional branching agent and optionally a transfer agent. A nonlimiting list of branching agents is found below: methylenebisacrylamide (MBA), ethylene glycol diacrylate, polyethylene glycol dimethacrylate, diacrylamide, cyanomethyl acrylate, vinyloxyethyl acrylate or methacrylate, triallylamine, formaldehyde, glyoxal, compounds of glycidyl ether type such as ethylene glycol diglycidyl ether, or epoxies or any other means well known to a person skilled in the art that permit crosslinking.

In practice, the branching agent is advantageously introduced in a proportion of five to fifty thousand (5 to 50 000) parts per million by weight relative to the active material, preferably 5 to 10 000, advantageously 5 to 5000 parts per million by weight. Advantageously, the branching agent is methylenebisacrylamide (MBA).

The incorporation of the additional polyfunctional compound within the base copolymer may be carried out in the reaction medium before or during the polymerization of the monomers constituting the base (co)polymer, or by any other method of grafting to the finished base copolymer.

Preferably, the additional polyfunctional compound is mixed with a comonomer before polymerization.

The transfer agent may especially be chosen, non-limitingly, from the group comprising isopropyl alcohol, sodium hypophosphite and mercaptoethanol.

The copolymer used as a base for the Hofmann degradation reaction does not require the development of a particular polymerization process. The principal polymerization techniques, well known to a person skilled in the art, and which may be used are: precipitation polymerization, emulsion (aqueous or inverse) polymerization, which may or may not be followed by a distillation and/or spray-drying step, and suspension polymerization or solution polymerization, these two techniques being preferred.

It is also possible to add to the base copolymer solution, before or during the Hofmann degradation reaction, certain compounds which are capable of reacting with the isocyanate functions of the polymer generated during the degradation. Generally, these are molecules bearing nucleophilic chemical functions such as hydroxyl functions or amine functions. As examples, the compounds in question may therefore be of the family of: alcohols, polyols, polyamines, polyethyleneimines.

The incorporation of salts of polyvalent cationic ions, as mentioned in document WO 2010/061082 by the applicant, may also be carried out.

As already specified, the Hofmann reaction requires the conversion of the amide functions to amine functions involving 2 main factors (expressed as molar ratios):

- Alpha=(alkali and/or alkaline-earth metal hypochlorite/(meth)acrylamide); and
- Beta=(alkali and/or alkaline-earth metal hydroxide/alkali and/or alkaline-earth metal hypochlorite).

Starting from a "base" copolymer solution described above having a concentration between 10% and 40% by weight, preferably between 15% and 25%, the molar quantity of total amide functions is determined. The level of Alpha degradation is then chosen, which makes it possible to determine the dry quantity of alkali and/or alkaline-earth metal hypohalide and then the Beta coefficient is chosen, which makes it possible to determine the dry quantity of alkali and/or alkaline-earth metal hydroxide.

A solution of alkali and/or alkaline-earth metal hypohalide and alkali and/or alkaline-earth metal hydroxide is then prepared from the alpha and beta ratios. According to the invention, the reactants preferably used are sodium hypochlorite (bleach) and caustic soda (sodium hydroxide).

In order to stabilize the amine functions that will be produced, it is optionally possible to add, to the reactor containing the base polymer, one (or optionally several) quaternary ammonium derivative(s) as is described in document JP 57077398 and is well known to a person skilled in the art, the purpose of which is specifically to prevent the reaction between the amine functions and the residual amide functions. Furthermore, it will be noted that the addition of these agents may be carried out separately, simultaneously, as a mixture or not, in any order of introduction and at one or more injection points.

The increase in cationicity of the base copolymer takes place during the Hofmann degradation, via the use of an alkali or alkaline-earth metal hypohalide.

Similarly, although prepared in solution, the polymers of the invention may also be proposed in solid form. Under these conditions, the solid form contains not only the copolymer, but also a proportion of salt obtained at the end of the Hofmann degradation reaction. In practice, they are obtained, inter alia, by processes that consist in drying the aforementioned solution. The main separation techniques then used are those of spray drying (which consists in creating a cloud of fine droplets in a hot gas stream for a controlled duration), drum drying, fluid bed dryers, etc.

The incorporation of the cationic polymer obtained by Hofmann degradation will be carried out with conventional means known to a person skilled in the art.

The process according to the invention will be able to be used with all types of stock: virgin fibre (kraft, bisulphite, etc.) stocks, recycled fibre stocks, deinked stocks, mechanical and thermomechanical stocks, etc.

As regards the fillers, they may be all the types of fillers that can be selected from the group comprising clays, kaolins, ground calcium carbonate (GCC), precipitated calcium carbonate (PCC), titanium dioxide, and mixtures thereof. The fillers will be able to be added in various forms, the slurry form being the most widely encountered. They will be able to be prepared with or without dispersant, away from or on the paper manufacturing site.

The cationic polymer obtained by Hofmann degradation will be able to be prepared in the vicinity of the papermaking machine.

The examples below make it possible to illustrate the invention, but have no limiting nature.

Polymer A:

Cationic polymer A is obtained by a Hofmann degradation reaction (alpha=1) on a base copolymer (20% base copolymer solution), of acrylamide (70 mol %) and of dimethyldiallylammonium chloride (DADMAC) (30 mol %) that is branched (MBA: 600 ppm/active material) modified with a polyethyleneimine polymer (of Polymin HM type by BASF), in an amount of 5% active material.

In order to do this, the polyethyleneimine is mixed with the DADMAC monomer and the MBA in the reactor.

The acrylamide will be incorporated by flowing continuously, over 2 h, into a reaction medium maintained at 85° C. The polymerization is catalyzed in the presence of SPS (sodium persulphate) and MBS (sodium metabisulphite), catalysts that are well known to a person skilled in the art. The precursor polymer thus obtained has a viscosity of 5500 cps (25° C., Brookfield LV3, 12 rpm).

The Hofmann degradation itself takes place in the same way as in example 1 of the document WO 2010/061082 by the applicant, by carrying out a complete Hofmann degradation. The cationic acrylamide-derived copolymer thus prepared has a bulk viscosity of 35 cps (25° C., Brookfield LV1, 60 rpm) and a concentration of 8.5% active material.

Polymer B:

Cationic polymer B is obtained by a Hofmann degradation reaction (alpha=1) on a base copolymer (20% active material), of acrylamide (60 mol %), of acrylic acid (10 mol %) and of dimethyldiallylammonium chloride (DADMAC) (30 mol %) that is branched (MBA: 600 ppm/active material) modified with a polyethyleneimine polymer (of Polymin HM type by BASF), in an amount of 5% active material.

In order to do this, the polyethyleneimine is mixed with the DADMAC monomer and the MBA in the reactor.

The acrylamide and the acrylic acid will be incorporated by flowing continuously, over 2 h, into a reaction medium maintained at 85° C. The polymerization is catalyzed in the presence of SPS and MBS, catalysts that are well known to a person skilled in the art. The precursor polymer thus obtained has a viscosity of 4500 cps (25° C., Brookfield LV3, 12 rpm).

The Hofmann degradation itself takes place in the same way as in example 1 of the document WO 2010/061082 by the applicant, by carrying out a complete Hofmann degradation. The cationic acrylamide-derived copolymer thus prepared has a bulk viscosity of 55 cps (25° C., Brookfield LV1, 60 rpm) and a concentration of 9%.

These polymers will be compared to (1) a high molecular weight acrylamide/ADAME MeCl powder copolymer (FO 4190 PG1, from SNF Floerger), standard retention aid, and (2) Luredur PR 8351 from BASF, amphoteric copolymer based on PVA (resulting from the hydrolysis of NVF), current reference as filler retention aid and aid for maintaining DSR performances.

Procedure for Evaluating the Dry Strength

Paper handsheets are produced with an automatic dynamic handsheet former.

The stock slurry is produced by disintegrating dry stock in order to obtain a final concentration of 3%.

The necessary amount of stock is withdrawn so as to obtain, in the end, a sheet having a basis weight of 60 g/m$^2$.

The concentrated stock is introduced into the chest of the dynamic handsheet former and stirred therein. Added to this stock is a slurry of fillers, injected at the same time as (but separately from) polymer A, B or Luredur PR 8351 from BASF. This stock is then diluted to a concentration of 0.32%.

In manual mode, the stock is pumped to the level of the nozzle in order to prime the circuit.

A blotting paper and the forming fabric are placed in the drum of the dynamic handsheet former before starting the rotation of the drum at 900 m/min and constructing the water wall. Potentially, a retention aid will be injected ten seconds before starting the sheet manufacturing cycle. The sheet is then produced (in automatic mode) by 22 to-and-fro movements of the nozzle spraying the stock into the water wall. Once the water is drained and once the automatic sequence is completed, the forming fabric with the network of fibres formed is removed from the drum of the dynamic handsheet former and placed on a table. A dry blotting paper is deposited on the side of the mat of wet fibres and is pressed once with a roller. The assembly is turned over and the fabric is carefully separated from the fibrous mat. A second dry blotting paper is deposited and the sheet (between the two blotting papers) is pressed once under a press delivering 4 bar and is then dried on a stretched dryer for 9 min at 107° C. The two blotting papers are subsequently removed and the sheet is stored overnight in a chamber with controlled humidity and controlled temperature (50% relative humidity and 23° C.). The dry strength properties of all the sheets obtained by this procedure are then evaluated.

The burst index is measured with a Messmer Buchel M 405 bursting strength tester (average over 14 measurements).

The dry tensile strength is measured in the machine direction with a Testometric AX tensile testing machine (average over 5 samples).

The content of fillers in the sheet is measured using a muffle furnace according to a standard procedure for measuring non-organic material (570° C. for 5 hours).

The tests are carried out with a stock having a neutral pH and having the following composition, by weight relative to the dry weight of the composition: (this composition exceeds 100% of material)

70% of bleached deciduous tree kraft fibres

10% of bleached resinous tree kraft fibres

20% of pine-based mechanical stock fibres

30% (by weight relative to the amount of fibres) of natural calcium carbonate are added to the stock.

Polymers Used Alone:

| Polymer | Polymer dosage | Burst index | Breaking length | % fillers in sheet |
|---|---|---|---|---|
| — | — | 1.51 | 3.82 | 16.73% |
| Polymer A | 300 g/t | 1.54 | 3.94 | 21.62% |
| Polymer B | 300 g/t | 1.52 | 3.92 | 20.54% |
| Luredur PR 8351 | 300 g/t | 1.53 | 3.94 | 20.51% |
| Polymer A | 600 g/t | 1.54 | 3.95 | 23.27% |
| Polymer B | 600 g/t | 1.53 | 3.93 | 21.97% |
| Luredur PR 8351 | 600 g/t | 1.54 | 3.95 | 22.12% |

It can be observed that polymer A provides better filler retention but also better DSR performances than Luredur PR 8351.

The amphoteric polymer B gives performances equivalent to Luredur PR 8351 but worse than polymer A.

Polymers Combined with a Standard Retention Aid:

| Polymer | Polymer dosage | Retention aid | Retention aid dosage | Burst index | Breaking length | % fillers in sheet |
|---|---|---|---|---|---|---|
| — | — | FO 4190 PG1 | 150 g/t | 1.53 | 3.93 | 20.02% |
| — | — | FO 4190 PG1 | 300 g/t | 1.50 | 3.74 | 23.32% |
| Polymer A | 150 g/t | FO 4190 PG1 | 150 g/t | 1.54 | 3.91 | 23.10% |
| Polymer B | 150 g/t | FO 4190 PG1 | 150 g/t | 1.52 | 3.91 | 22.01% |
| Luredur PR 8351 | 150 g/t | FO 4190 PG1 | 150 g/t | 1.53 | 3.92 | 22.05% |
| Polymer A | 300 g/t | FO 4190 PG1 | 150 g/t | 1.54 | 3.93 | 25.37% |
| Polymer B | 300 g/t | FO 4190 PG1 | 150 g/t | 1.53 | 3.93 | 23.38% |
| Luredur PR 8351 | 300 g/t | FO 4190 PG1 | 150 g/t | 1.54 | 3.94 | 23.44% |

In a manner known to a person skilled in the art, the simple use of a retention aid provides retention of fillers, but greatly deteriorates the physical performances.

In combination with a retention aid, polymer A makes it possible to obtain the highest amount of fillers in the paper sheet while retaining good physical strength properties of the sheet.

The invention claimed is:

1. A process for manufacturing a sheet of paper and/or board, said process comprising, in a plant comprising a fan pump and a head box:

preparing a cellulose fibre suspension, referred to as thick stock;

introducing into the thick stock white waters resulting from drainage of the sheet, thereby forming a mixture;

homogenizing the mixture in the fan pump, thereby forming a thin stock;

transferring the thin stock resulting from the homogenization to the head box;

forming the sheet; and drying the sheet, wherein, before homogenizing the mixture in the fan pump, a cationic copolymer obtained by Hofmann degradation reaction is introduced into the white waters and/or the thick stock and/or the mixture formed by the white waters and the thick stock.

2. The process according to claim 1, said process further comprising introducing fillers into the thick stock, and wherein the cationic copolymer is introduced in the immediate vicinity of the filler introduction point or points.

3. The process according claim 2, wherein the fillers are selected from the group consisting of clays, kaolins, ground calcium carbonate (GCC), precipitated calcium carbonate (PCC), titanium dioxide, and mixtures thereof.

4. The process according to claim 1, wherein fillers are introduced into the thick stock, and wherein the cationic copolymer is introduced simultaneously with the fillers.

5. The process according to claim 4, wherein the fillers are introduced in the form of a slurry, and wherein the cationic copolymer is introduced into the filler slurry or during the preparation thereof.

6. The process according claim 5, wherein the fillers are selected from the group consisting of clays, kaolins, ground calcium carbonate (GCC), precipitated calcium carbonate (PCC), titanium dioxide, and mixtures thereof.

7. The process according claim 4, wherein the fillers are selected from the group consisting of clays, kaolins, ground calcium carbonate (GCC), precipitated calcium carbonate (PCC), titanium dioxide, and mixtures thereof.

8. The process according to claim 4, wherein the fillers are selected from the group consisting of clays, kaolins, ground calcium carbonate (GCC), precipitated calcium carbonate (PCC), titanium dioxide, and mixtures thereof, and wherein the cationic copolymer is obtained by Hofmann degradation reaction on a precursor based on acrylamide or derivatives, otherwise referred to as base (co)polymer, previously modified with at least one polyfunctional compound containing at least 3 identical or different heteroatoms that each have at least one mobile hydrogen.

9. The process according to claim 8, wherein the polyfunctional compound is selected from the group consisting of polyethyleneimines (PEIs), polyamines (primary or secondary), polyallylamines, polyamine amides (PAAs), polythiols, polyalcohols, polyamide-epichlorohydrin (PAE) resins, and mixtures thereof.

10. The process according to claim 8, wherein the base (co)polymer is branched by addition of a polyfunctional branching agent and optionally a transfer agent.

11. The process according to claim 10, wherein the hypohalide/nonionic monomer Alpha coefficient (expressed as molar ratio) used for preparation of the polymer is between 0.8 and 1 inclusive.

12. The process according to claim 8, wherein the hypohalide/nonionic monomer Alpha coefficient (expressed as molar ratio) used for preparation of the polymer is between 0.8 and 1 inclusive.

13. The process according to claim 1, wherein the cationic copolymer is introduced into the white waters.

14. The process according to claim 13, wherein the cationic copolymer is introduced into the white waters just before introducing said white waters into the thick stock.

15. The process according to claim 1, wherein the cationic copolymer is obtained by Hofmann degradation reaction on a precursor based on acrylamide or derivatives, otherwise referred to as base (co)polymer, previously modified with at least one polyfunctional compound containing at least 3 identical or different heteroatoms that each have at least one mobile hydrogen.

16. The process according to claim 15, wherein the polyfunctional compound is selected from the group consisting of polyethyleneimines (PEIs), polyamines (primary or secondary), polyallylamines, polyamine amides (PAAs), polythiols, polyalcohols, polyamide-epichlorohydrin (PAE) resins, and mixtures thereof.

17. The process according to claim 16, wherein the hypohalide/nonionic monomer Alpha coefficient (expressed as molar ratio) used for preparation of the polymer is between 0.8 and 1 inclusive.

18. The process according to claim 15, wherein the base (co)polymer is branched by addition of a polyfunctional branching agent and optionally a transfer agent.

19. The process according to claim 18, wherein the hypohalide/nonionic monomer Alpha coefficient (expressed as molar ratio) used for preparation of the polymer is between 0.8 and 1 inclusive.

20. The process according to claim 15, wherein the hypohalide/nonionic monomer Alpha coefficient (expressed as molar ratio) used for preparation of the polymer is between 0.8 and 1 inclusive.

* * * * *